US011214060B2

(12) United States Patent
Schulte et al.

(10) Patent No.: US 11,214,060 B2
(45) Date of Patent: Jan. 4, 2022

(54) GAPS BETWEEN ELECTRICALLY CONDUCTIVE GROUND STRUCTURES

(71) Applicant: HEWLETT-PACKARD DEVELOPMENT COMPANY, L.P., Spring, TX (US)

(72) Inventors: Donald W. Schulte, Corvallis, OR (US); Donald J. Milligan, Corvallis, OR (US); Terry McMahon, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/605,040

(22) PCT Filed: Dec. 8, 2017

(86) PCT No.: PCT/US2017/065412

§ 371 (c)(1),
(2) Date: Oct. 14, 2019

(87) PCT Pub. No.: WO2019/112620

PCT Pub. Date: Jun. 13, 2019

(65) Prior Publication Data

US 2021/0129543 A1 May 6, 2021

(51) Int. Cl.
*B41J 2/14* (2006.01)
*B41J 2/175* (2006.01)

(52) U.S. Cl.
CPC ..... *B41J 2/14129* (2013.01); *B41J 2/14072* (2013.01); *B41J 2/1753* (2013.01); *B41J 2/14201* (2013.01); *B41J 2002/14491* (2013.01)

(58) Field of Classification Search
CPC .. B41J 2/14129; B41J 2/14072; B41J 2/1753; B41J 2/14201; B41J 2002/14491
See application file for complete search history.

(56) References Cited

U.S. PATENT DOCUMENTS

| | | | |
|---|---|---|---|
| 5,045,870 | A | 9/1991 | Lamey et al. |
| 5,980,025 | A | 11/1999 | Burke et al. |
| 6,318,846 | B1 | 11/2001 | Saul |
| 6,371,597 | B1 | 4/2002 | DeMeerleer et al. |
| 6,491,377 | B1 | 12/2002 | Cleland et al. |

(Continued)

FOREIGN PATENT DOCUMENTS

| | | |
|---|---|---|
| CN | 1421316 | 6/2003 |
| CN | 101035678 | 9/2007 |

(Continued)

OTHER PUBLICATIONS

Serial-parallel 3-input Driver, 2015, http://www.mouser.com/ds/2/348/ba823f-e-209384.pdf.

*Primary Examiner* — Geoffrey S Mruk
(74) *Attorney, Agent, or Firm* — Trop Pruner & Hu PC

(57) ABSTRACT

In some examples, a fluid dispensing die includes a plurality of fluid actuators to cause dispensing of a fluid from respective nozzles of the fluid dispensing die, and an electrically conductive layer including electrically conductive ground structures to connect respective fluid actuators of the plurality of fluid actuators to a ground, wherein the electrically conductive layer includes gaps provided between the electrically conductive ground structures of the electrically conductive layer.

17 Claims, 5 Drawing Sheets

(56) References Cited

U.S. PATENT DOCUMENTS

| | | | | |
|---|---|---|---|---|
| 7,083,265 | B2 | 8/2006 | Conors et al. | |
| 7,344,227 | B2 | 3/2008 | King et al. | |
| 7,798,611 | B2 | 9/2010 | Connors et al. | |
| 8,075,103 | B2 * | 12/2011 | Furukawa | B41J 2/04541 347/58 |
| 8,523,329 | B2 | 9/2013 | Tamaru et al. | |
| 2003/0081067 | A1 | 5/2003 | Conners et al. | |
| 2006/0232634 | A1 | 10/2006 | Connors et al. | |
| 2007/0139475 | A1 | 6/2007 | King et al. | |
| 2009/0002458 | A1 | 1/2009 | Tatsuo et al. | |
| 2014/0063129 | A1 | 3/2014 | Hirofumi | |
| 2014/0132674 | A1 | 5/2014 | Souta et al. | |
| 2015/0102835 | A1 | 4/2015 | Maikel et al. | |
| 2015/0290935 | A1 | 10/2015 | Shuici | |

FOREIGN PATENT DOCUMENTS

| | | | |
|---|---|---|---|
| CN | 101960565 | | 1/2011 |
| CN | 106102308 | | 11/2016 |
| JP | 07068759 | | 3/1995 |
| JP | 2000127407 | | 5/2000 |
| JP | 2006187188 | | 7/2006 |
| JP | 2009-029116 | A | 2/2009 |
| JP | 2009233939 | | 10/2009 |
| JP | 2010099917 | | 5/2010 |
| JP | 2010-208136 | A | 9/2010 |
| JP | 2017196787 | | 11/2017 |
| WO | WO2009108201 | A1 | 9/2009 |
| WO | WO-2013002775 | | 1/2013 |

* cited by examiner

GAPS BETWEEN ELECTRICALLY CONDUCTIVE GROUND STRUCTURES

BACKGROUND

A fluid dispensing system can dispense fluid towards a target. In some examples, a fluid dispensing system can include a printing system, such as a two-dimensional (2D) printing system or a three-dimensional (3D) printing system. A printing system can include printhead dies that include nozzles for dispensing printing fluids.

BRIEF DESCRIPTION OF THE DRAWINGS

Some implementations of the present disclosure are described with respect to the following figures.

Figure 1A:
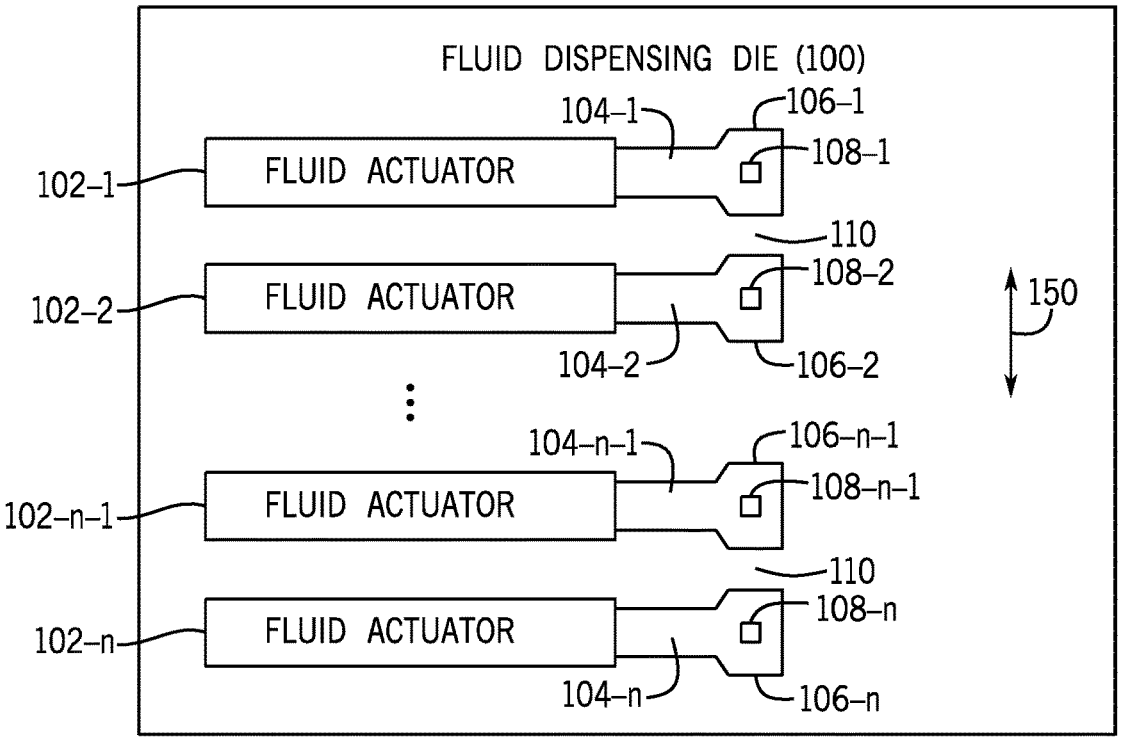
FIG. 1A is a block diagram of a portion of a fluid dispensing die, according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an", or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

A fluid dispensing die has nozzles through which a fluid can be dispensed. The fluid dispensing die further includes fluid actuators that when activated cause the dispensing of the fluid from the respective nozzles. In some examples, the fluid actuators include heating elements, such as heating resistors. When a heating element is activated, the heating element produces heat that can cause vaporization of a fluid to cause ejection of the fluid from an orifice of a nozzle. In other examples, a fluid actuator when activated can apply a mechanical force to eject a fluid from an orifice of a nozzle. An example of such a fluid actuator is a piezoelectric element, which when activated deflects to apply the mechanical force for fluid ejection.

In some examples, the fluid actuators of a fluid dispensing die can be connected to a common ground bus in a metal layer (such as a metal 1 or M1 layer). To reduce parasitics due to presence of resistance in conductive paths to ground, a common ground trace can also be formed in another metal layer (such as a metal 2 or M2 layer), where the common ground trace in the M2 layer is connected by vias to the ground bus in the M1 layer. The terminology "M1 layer" and "M2 layer" refers to different layers of metal that form a device, such as a fluid dispensing die. During manufacture of the device, the M1 layer is formed first, followed by the M2 layer (with possibly intervening layer(s) between the M1 and M2 layers).

In the example arrangements discussed above, a failure of a fluid actuator can cause propagation of corrosion along the common ground trace in the M2 layer, and possibly also through the common ground bus in the M1 layer. Even though a fluid actuator has failed, an activation signal can still be provided to the failed fluid actuator, which can enhance the deterioration of the failed fluid actuator. For example, if the failed fluid actuator is a heating resistor, then repeated provision of an activation signal to the failed heating resistor can cause additional melting of the failed heating resistor, which can cause corrosive effects that can be propagated along the common ground trace in the M2 layer (and possibly also through the common ground bus in the M1 layer) to neighboring heating resistors. The propagation of corrosion can quickly spread from one heating resistor to the next such that successive failure of multiple adjacent heating resistors can occur over time.

Although individual fluid actuator failures can be masked using a specified algorithm, clusters of failed fluid actuators can lead to visible failure artifacts that can lead to premature replacement of a fluid dispensing die. For example, if the fluid dispensing die is a printhead die, then the visible failure artifacts can appear in an image printed by the printhead die (for two-dimensional or 2D printing) or in a printed layer of a three-dimensional (3D) object (for 3D printing).

In accordance with some implementations of the present disclosure, isolation of ground-connecting electrically conductive structures (referred to as "electrically conductive ground structures) in an electrically conductive layer (e.g., an M2 layer) of a fluid dispensing die can be provided to isolate corrosive effects of fluid actuators of the fluid dispensing die from one another. An electrically conductive ground structure is an electrically conductive structure that has a connecting element that is connected to a ground of the fluid dispensing die. Gaps can also be formed between ground contact structures of a ground bus in another electrically conductive layer (e.g., an M1 layer).

In the present disclosure, an "electrically conductive layer" can refer to a single layer of electrically conductive material, or to a stack of multiple layers of electrically conductive materials.

FIG. 1A shows an example fluid dispensing die 100 that includes multiple fluid actuators 102-1, 102-2, . . . , **102-*n*, where n>1. Although four fluid actuators are shown in FIG. 1A, in other examples, a different number of fluid actuators can be included in the fluid dispensing die 100**.

Each fluid actuator 102 (any of 102-1 to **102-*n***) can be implemented as a heating resistor, a piezoelectric element, or any other fluid actuator that when activated causes dispensing of fluid from a respective nozzle.

The fluid actuators 102-1, 102-2, . . . **102-*n* are connected by respective conductive traces 104-1, 104-2, . . . , 104-*n* to corresponding electrically conductive ground structures 106-1, 106-2, . . . , 106-*n***.

In examples according to FIG. 1A, each electrically conductive ground structure 106 (any of 106-1 to **106-*n*) includes a via 108 (a corresponding one of the vias 108-1, 108-2, . . . , 108-*n*) to a ground bus. A via refers to an electrically conductive connecting structure that can electrically connect elements in multiple electrically conductive layers (e.g., M1 and M2 layers). Although FIG. 1A shows each electrically conductive ground structure 106 with just one respective via 108, it is noted that in other examples, an electrically conductive ground structure 106** can include multiple vias to connect to the ground bus.

In the arrangement of FIG. 1A, an electrically conductive ground structure 106 includes the electrically conductive material that immediately surrounds the via(s) 108, and does not include the respective conductive trace 104 (the corresponding one of the conductive traces 104-1, 104-2, . . . , **104-*n***).

The electrically conductive ground structures 106 can also be referred to as ground return electrodes that connect respective fluid actuators 602 to a ground. The ground return electrodes can be formed in metal layer, for example.

In examples according to FIG. 1A, the conductive traces 104-1, 104-2, . . . , **104-*n* and the electrically conductive ground structures 106-1, 106-2, . . . , 106-*n* are formed in a first electrically conductive layer (e.g., an M2 layer). Although not shown in FIG. 1A, the second electrically conductive layer (e.g., an M1 layer) includes a ground bus to which the electrically conductive ground structures 106-1 to 106-*n* are connected by the vias 108-1 to 108-*n***.

In the present disclosure, a metal layer such as the M1 or M2 layer can refer to a single metal layer, or a stack of multiple metal layers.

The isolation of the electrically conductive ground structures 106-1 to **106-*n* in the M2 layer (which is an example of a first electrically conductive layer) can be achieved by forming gaps 110 in the M2 layer between the electrically conductive ground structures 106. More specifically, each gap 110 is formed between adjacent (or successive) electrically conductive ground structures 106. For example, one gap 110 is formed between electrically conductive ground structures 106-1 and 106-2, while another gap 110 is formed between electrically conductive ground structures 106-*n*-1 and 106-*n***.

Each gap 110 effectively provides an isolation space between a via 108 of a first electrically conductive ground structure 106 and a via 108 of an adjacent second electrically conductive ground structure 106, along an axis 150 that is generally perpendicular to the direction along which the fluid actuators 102-1 to **102-*n* and the conductive traces 104-1 to 104-*n*** extend.

Figure 1B:
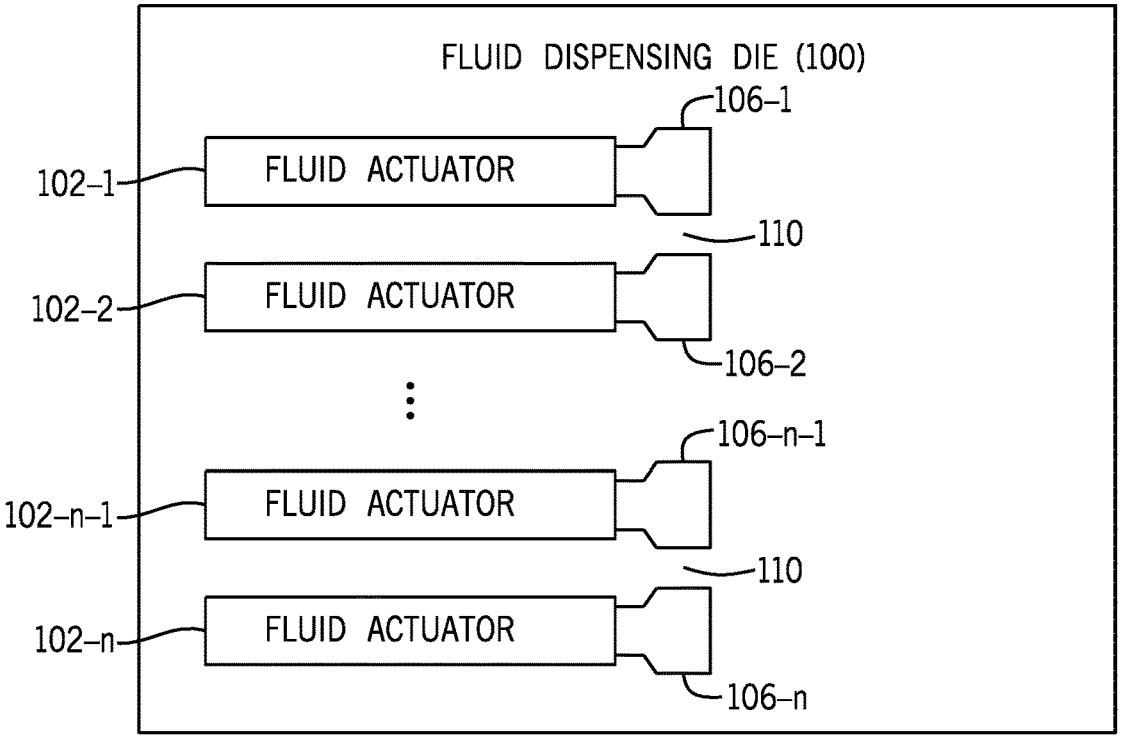
FIG. 1B is a block diagram of a portion of a fluid dispensing die, according to some examples.

FIG. 1B shows another example fluid dispensing die 100 that includes multiple fluid actuators 102-1, 102-2, . . . , **102-*n*, where n>1. Although four fluid actuators are shown in FIG. 1B, in other examples, a different number of fluid actuators can be included in the fluid dispensing die 100**.

The fluid actuators 102-1, 102-2, . . . **102-*n* are connected to corresponding electrically conductive ground structures 106-1, 106-2, . . . , 106-*n***.

The ground structures 106-1, 106-2, . . . , **106-*n* are part of an electrically conductive layer to connect respective fluid actuators 102-1, 102-2, . . . 102-*n* to a ground (such as a ground bus). The electrically conductive layer includes gaps 110 provided between the electrically conductive ground structures 106-1, 106-2, . . . , 106-*n***.

Figure 2:
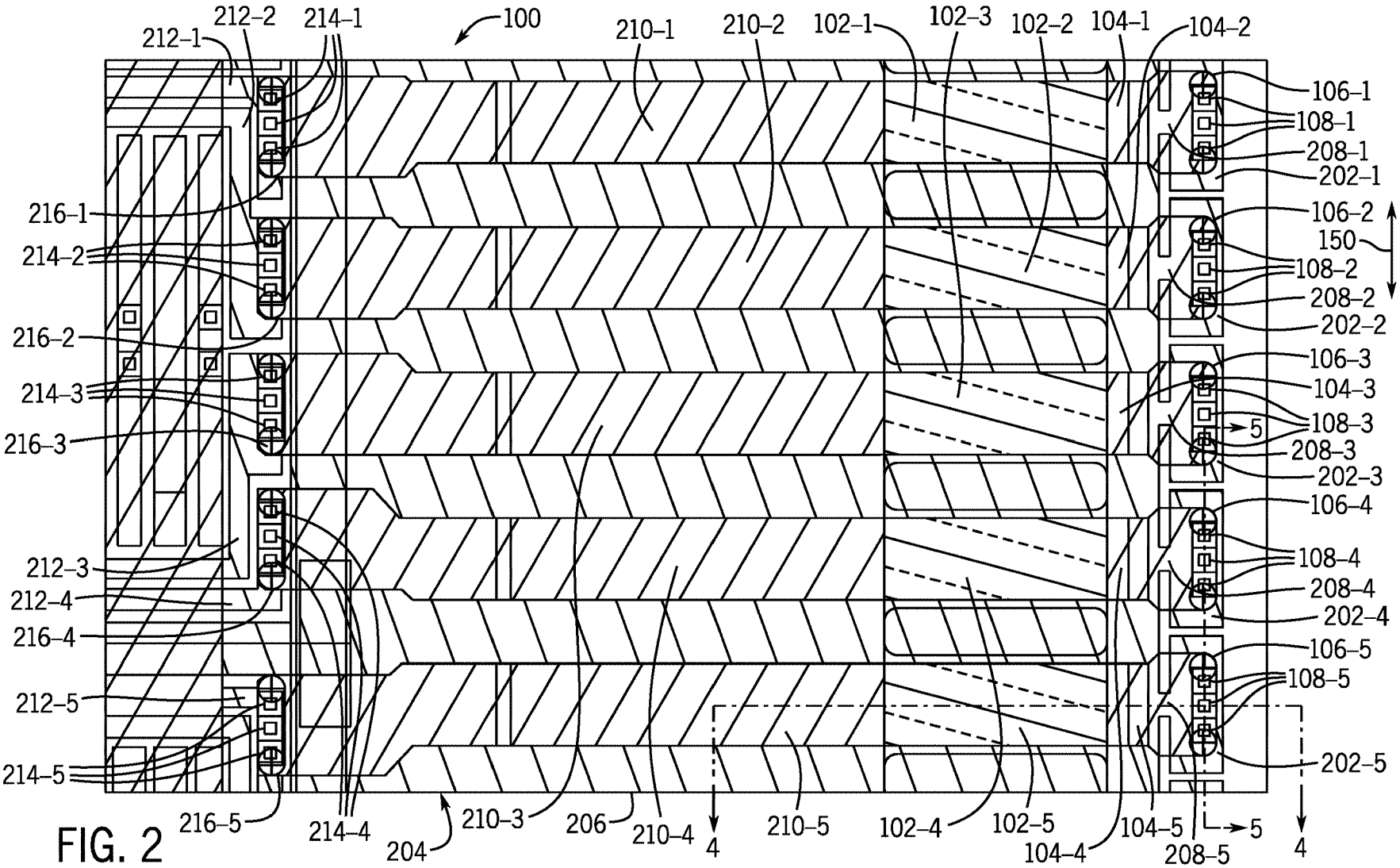
FIG. 2 is a top view of a portion of a fluid dispensing die, according to further examples.

FIG. 2 is a top view of a portion of a fluid dispensing die 100 according to further examples. In FIG. 2, five fluid actuators 102-1, 102-2, 102-3, 102-4, and 102-5 are shown. Although five fluid actuators 102-1 to 102-5 are shown in FIG. 2, it is noted that the fluid dispensing die 100 can include a larger number or a smaller number of fluid actuators.

In examples where each fluid actuator 102 (any of 102-1 to 102-5) is formed of a heating resistor, the heating resistor can include a resistive material, such as tungsten silicon nitride (WSiN) or some other type of resistive material.

Each fluid actuator 102-1, 102-2, 102-3, 102-4, or 102-5 is connected by a respective electrically conductive trace 104-1, 104-2, 104-3, 104-4, or 104-5 to a corresponding electrically conductive ground structure 106-1, 106-2, 106-3, 106-4, or 106-5.

Each electrically conductive ground structure 106-1, 106-2, 106-3, 106-4, or 106-5 has a corresponding set of vias 108-1, 108-2, 108-3, 108-4, or 108-5 to electrically connect the corresponding electrically conductive ground structure to a corresponding ground contact structure 202-1, 202-2, 202-3, 202-4, or 202-5. For example, the set of vias 108-1 electrically connects the electrically conductive ground structure 106-1 to the ground contact structure 202-1, the set of vias 108-2 electrically connects the electrically conductive ground structure 106-2 to the ground contact structure 202-2, and so forth.

The conductive traces 104-1 to 104-4 and the electrically conductive ground structures 106-1 to 106-5 are formed in a first electrically conductive layer, such as the M2 layer. In FIG. 2, the M2 layer is drawn to be partially transparent to allow structures underneath the M2 layer to be visible.

The ground contact structures 202-1 to 202-5 are part of a ground bus 204 that is formed in a second electrically conductive layer (e.g., an M1 layer). The ground bus 204 includes a main ground bus portion 206 that is electrically connected by connecting portions 208-1, 208-2, 208-3, 208-4, and 208-5 to the corresponding ground contact structures 202-1, 202-2, 202-3, 202-4, and 202-5. The main ground bus portion 206 of the ground bus 204 is electrically connected to the ground (e.g., a ground pad) of the fluid dispensing die 100.

Each connecting portion 208-1, 208-2, 208-3, 208-4, or 208-5 that electrically connects the respective ground contact structure 202-1, 202-2, 202-3, 202-4, or 202-5 to the main ground bus portion 206 has a width (along axis 150) that is narrower than the width (along axis 150) of the respective ground contact structure 202-1, 202-2, 202-3, 202-4, or 202-5. The narrowed connecting portion 208-1, 208-2, 208-3, 208-4, or 208-5 is formed based on the formation of generally T-shaped gaps in the second electrically conductive layer (e.g., the M1 layer), which are discussed further below. By using the narrowed connecting portions 208-1, 208-2, 208-3, 208-4, and 208-5 to electrically connect to the ground contact structures 202-1, 202-2, 202-3, 202-4, and 202-5 to the main ground bus portion 206, the likelihood of propagating corrosion from a failed fluid actuator 102 through the first and second electrically conductive layers to another fluid actuator 102 is reduced.

The conductive traces 104-1 to 104-5 electrically connect the first side of the fluid actuators 102-1 to 102-5 to the corresponding electrically conductive ground structures 106-1 to 106-5.

In addition, electrically conductive traces 210-1, 210-2, 210-3, 210-4, and 210-5 electrically connect second sides of the fluid actuators 102-1 to 102-5 to corresponding signal lines 212-1, 212-2, 212-3, 212-4, and 212-5. The signal lines 212-1, 212-2, 212-3, 212-4, and 212-5 provide activation signals to the corresponding fluid actuators 102-1 to 102-5. The electrically conductive traces 210-1 to 210-5 are connected to the respective signal lines 212-1 to 212-5 through corresponding sets of vias 214-1, 214-2, 214-3, 214-4, and 214-5.

The sets of vias 214-1 to 214-5 electrically connect signal contact portions 216-1 to 216-5, respectively, to corresponding signal lines 212-1 to 212-5. The electrically conductive traces 210-1 to 210-5 electrically connect the fluid actuators 102-1 to 102-5 to corresponding signal contact portions 216-1 to 216-5. Activation signals are provided over the signal lines 212-1 to 212-5 to activate the corresponding fluid actuators 102-1 to 102-5.

Figure 3:
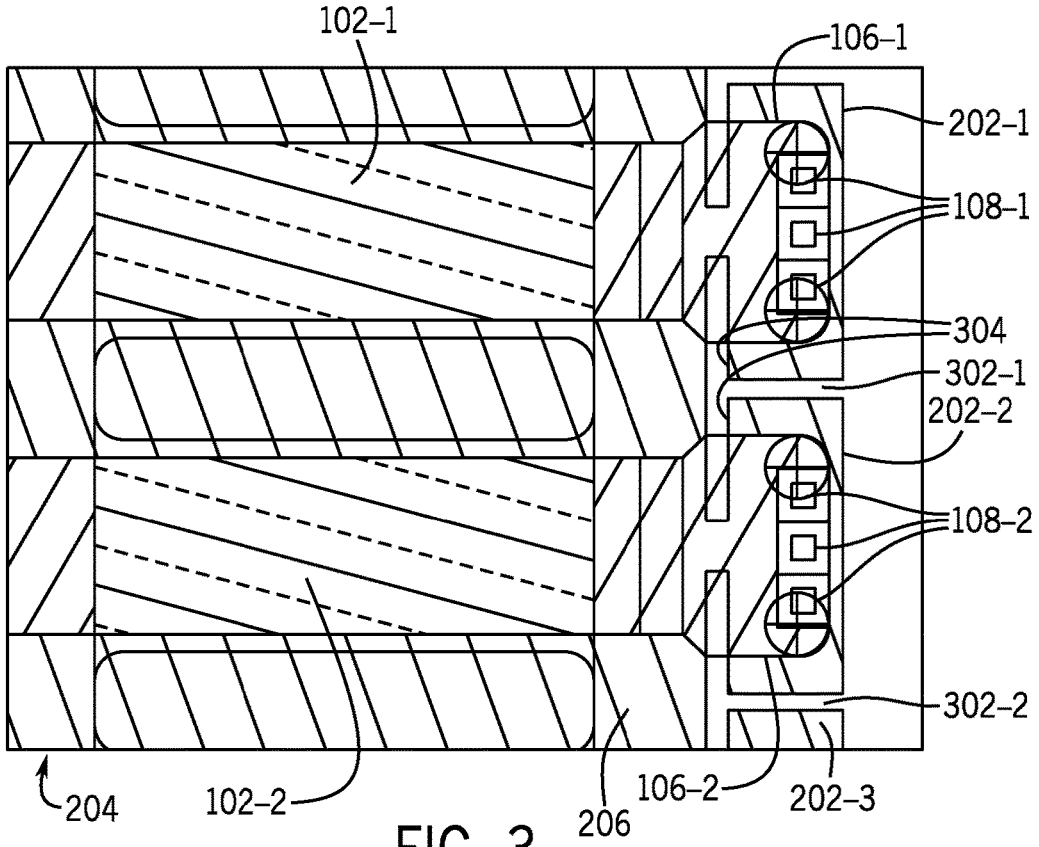
FIG. 3 is a top view of an enlarged portion of a fluid dispensing die, according to further examples.

In further examples, as shown in an enlarged view depicted in FIG. 3 of a portion of the fluid dispensing die 100 of FIG. 2, gaps can also be provided in the second electrically conductive layer (e.g., the M1 layer) of the fluid dispensing die 100, to enhance the isolation of any defective fluid actuators. In FIG. 3, the M2 layer is drawn to be partially transparent to allow structures underneath the M2 layer to be visible.

In FIG. 3, the gaps in the second electrically conductive layer include a gap 302-1 between the ground contact structures 202-1 and 202-2, and a gap 302-2 between the ground contact structures 202-2 and 202-3. As shown in FIG. 3, the gap 302-1 is formed in the second electrically conductive layer in a space between the set of vias 108-1 that connects the electrically conductive ground structure 106-1 and the set of vias 108-2 that connects the electrically conductive ground structure 106-2. More generally, a gap in the second electrically conductive layer is provided between adjacent (successive) ground contact structures 202 (any of 202-1 to 202-5 in FIG. 3) of the ground bus 204.

By forcing a ground path of each fluid actuator to include an electrically conductive ground structure 106 (of the first electrically conductive layer) that is isolated from other electrically conductive ground structures 106 of the first electrically conductive layer, and a via 108 (or multiple vias 108) to the ground bus 204 in the second electrically conductive layer, the corrosion propagation effect of a failed fluid actuator can be reduced. In addition, the gaps (e.g., 302-1 and 302-2) provided around the ground contact structures 202 of the ground bus 204 in the second electrically conductive layer provide further reduction of corrosion propagation.

As shown in FIG. 3, a first side of the ground contact structure 202-1 is separated by the gap 302-1 in the second electrically conductive layer from the ground contact structure 202-2. In addition, a second side of the ground contact structure 202-1 is separated by another gap 304 in the second electrically conductive layer from the main portion 206 of the ground bus 204.

In addition, as shown in FIG. 3, a first side of the ground contact structure 202-2 is separated by the gap 302-2 in the second electrically conductive layer from the ground contact structure 202-3. Further, a second side of the ground contact structure 202-2 is separated by the gap 304 in the second electrically conductive layer from the main ground bus portion 206 of the ground bus 204.

The gap 304 and the gap 302-1 form a generally T-shaped gap in the ground bus 204. In other examples, gaps in the second electrically conductive layer (e.g., the M1 layer) can have other shapes.

Similar T-shaped gaps are provided between other ground contact structures and the main ground bus portion 206. As explained above, the T-shaped gaps allow the formation of the narrowed connecting portion 208-1, 208-2, 208-3, 208-4, or 208-5 between the ground contact portions 202-1 to 202-5 and the main ground bus portion 206.

Figure 4:
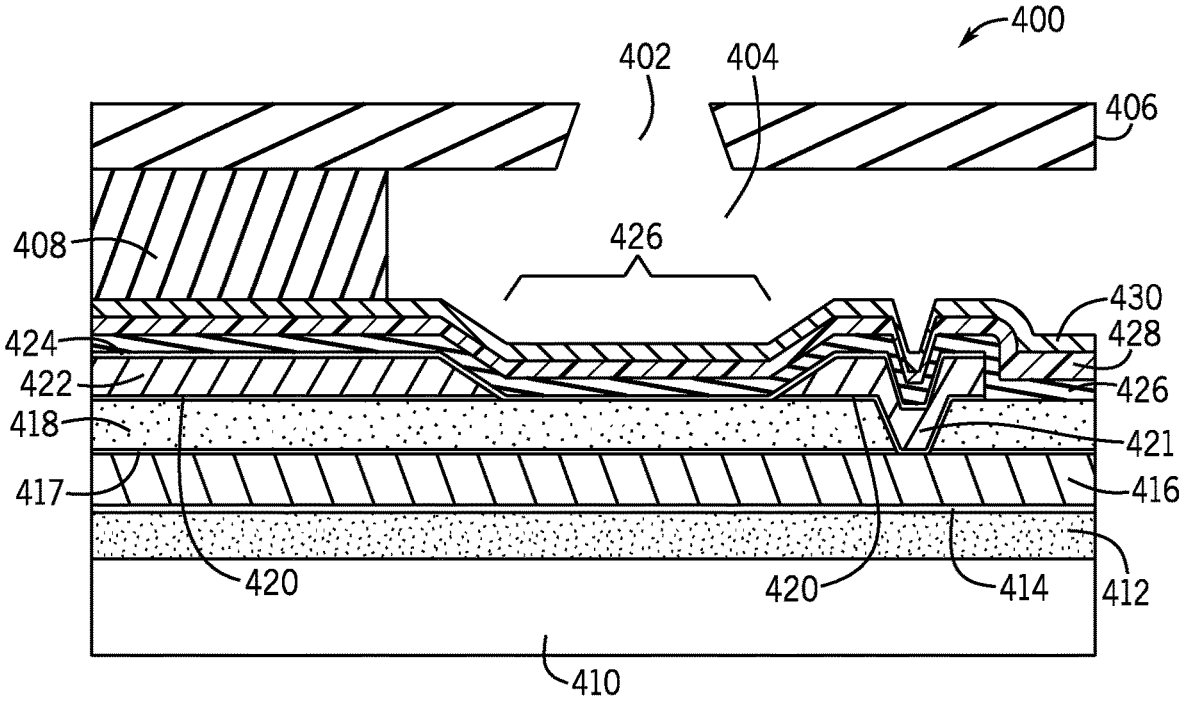
FIGS. 4 and 5 are cross-sectional views of various portions of a fluid dispensing die, according to some examples.

FIG. 4 is a cross-sectional view of the section 4-4 of FIG. 2, to show the layers of a nozzle 400 according to some examples. It is noted that in other examples, other or alternative layers (including a different order of layers) can form the nozzle 400.

The nozzle 400 includes an orifice 402 that can be defined by an orifice photoresist layer 406, which can be formed of an electrically insulating layer, such as an epoxy-based material (e.g., SU8) or another type of electrically insulating material.

The orifice 402 is fluidically connected to a firing chamber 404 that is defined by an electrically insulating layer 408, which can also include a photoresist layer similar to the orifice layer 406.

The firing chamber 404 receives a fluid from a fluid feed slot (not shown) in the fluid dispensing die 100. When a corresponding fluid actuator is activated, the fluid in the firing chamber 404 can be ejected through the orifice 402 to the outside of the nozzle 400. In examples where the fluid actuator is a heating resistor, activation of the heating resistor causes vaporization of the fluid in the firing chamber 404 to cause ejection of a droplet of fluid through the orifice 402.

The layers of the nozzle 400 are formed on a substrate 410, which can be a silicon substrate or a substrate of another semiconductor material. In the examples according to FIG. 4, an electrically insulating layer 412 is formed on the surface of the substrate 410. The electrically insulating layer 412 can include silicon oxide ($SiO_2$) or some other type of electrically insulating material.

A diffusion barrier 414 is formed over the electrically insulating layer 412. The diffusion barrier 414 can include a titanium nitride (TiN) thin film, or can include some other type of material that blocks or reduces diffusion of metal or other materials.

An electrically conductive layer 416 is formed over the diffusion barrier 414. In some examples, the electrically conductive layer 416 can be formed of a metal, such as aluminum or some other type of metal, or can be formed of a non-metallic electrically conductive material.

Another electrically conductive layer 417 (e.g., a TiN thin film) is deposited over the electrically conductive layer 416. The layer 417 can serve multiple purposes, including reducing reflectivity to facilitate photolithographic processing, electromigration mitigation, and acting as a diffusion barrier. In examples where layer 416 is formed of a metal, the stack of electrically conductive layers 414, 416 and 417 is collectively referred to as the M1 layer.

An electrically insulating layer 418 is formed over the layer 417. The electrically insulating layer 418 can be formed using $SiO_2$ or some other type of electrically insulating material.

Another electrically conductive layer 420 (e.g., a TiN thin film) can be formed over the electrically insulating layer 418.

A further electrically conductive layer 422 is formed over the layer 420. The electrically conductive layer 422 can be formed of a metal (e.g., aluminum or a different metal) or a non-metallic electrically conductive material.

As further shown in FIG. 4, prior to deposition of the layer 420 over the electrically insulating layer 418, a portion of the electrically insulating layer 418 (at 421) is removed. Removal of the portion of the electrically insulating layer 418 at 421 forms a window in the electrically insulating layer 418. The subsequently formed layer 420 and electrically conductive layer 422 are formed in the window in the electrically insulating layer 418, to provide a via 421 that is made of the electrically conductive layers 422 and 420. The via 421 electrically connects the fluid actuator to the electrically conductive layer 416, in which the ground bus 204 is formed as depicted in FIG. 2.

At the via 421, the layer 420 provides a diffusion barrier between the electrically conductive layer 416 and the electrically conductive layer 422, to inhibit propagation of corrosion between the electrically conductive layer 416 and the electrically conductive layer 422 due to failure of a fluid actuator.

A resistive layer 424 including an electrically resistive material, such as WSiN or a different type of resistive material, can be formed over the electrically conductive layer 422. In a region 426 that corresponds to the location of a fluid actuator 102 as shown in FIG. 1A, 1B, 2, or 3, a portion of the electrically conductive layers 420 and 422 are removed (such as by etching). The resistive layer 424 is formed over the electrically conductive layers 420 and 422 after the removal of the electrically conductive layers 420 and 422 in the region 426. As a result, in the region 426, the resistive material 424 is present, but the electrically conductive layers 420 and 422 are not. In examples where the fluid actuator is formed using a heating resistor, the portion of the resistive layer 424 in the region 426 forms the heating resistor. In areas other than the region 426, the stack of electrically conductive layers 420, 422 and 424 can be referred to as an M2 layer.

As further shown in FIG. 4, a passivation layer 426 is formed over the resistive layer 424, and another passivation layer 428 is formed over the passivation layer 426. In some examples, the passivation layer 426 can include silicon nitride (SiN), and the passivation layer 428 can include silicon carbide (SiC). In other examples, other types of passivation materials can be employed.

An anti-cavitation wear layer 430 is formed over the passivation layer 428. In some examples, the anti-cavitation wear layer 430 can include tantalum (Ta) or some other material. The anti-cavitation wear layer 430 and passivation layers 426 and 428 provide protection of the fluid actuator and the electrically conductive layer 422 from the fluids in the firing chamber 404.

Figure 5:
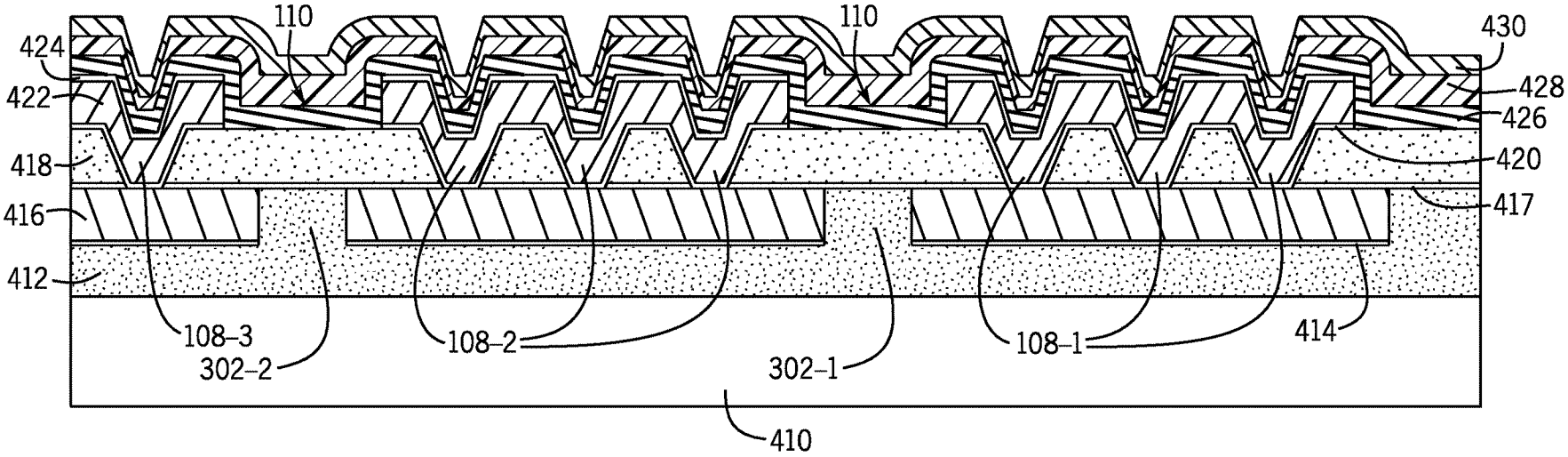

FIG. 5 is a cross-sectional view of the section 5-5 of the fluid dispensing die 100 shown in FIG. 2. It is noted that in other examples, other or alternative layers (including a different order of layers) can be employed.

In FIG. 5, vias 108-1, 108-2, and 108-3 formed using the electrically conductive layer stack 420, 422 and 424 are depicted. In addition, gaps 110 in the electrically conductive layer stack 420, 422 and 424 (an example of the M2 layer) between respective electrically conductive ground structures (shown as 106-1, 106-2, and 106-3 in FIG. 2) are illustrated. Furthermore, gaps 302-1 and 302-2 in the electrically conductive layer stack 414, 416 and 417 (an example of the M1 layer) between the ground contact structures 202-1, 202-2, and 202-3 of FIG. 3 are also depicted in FIG. 5.

Figure 6:
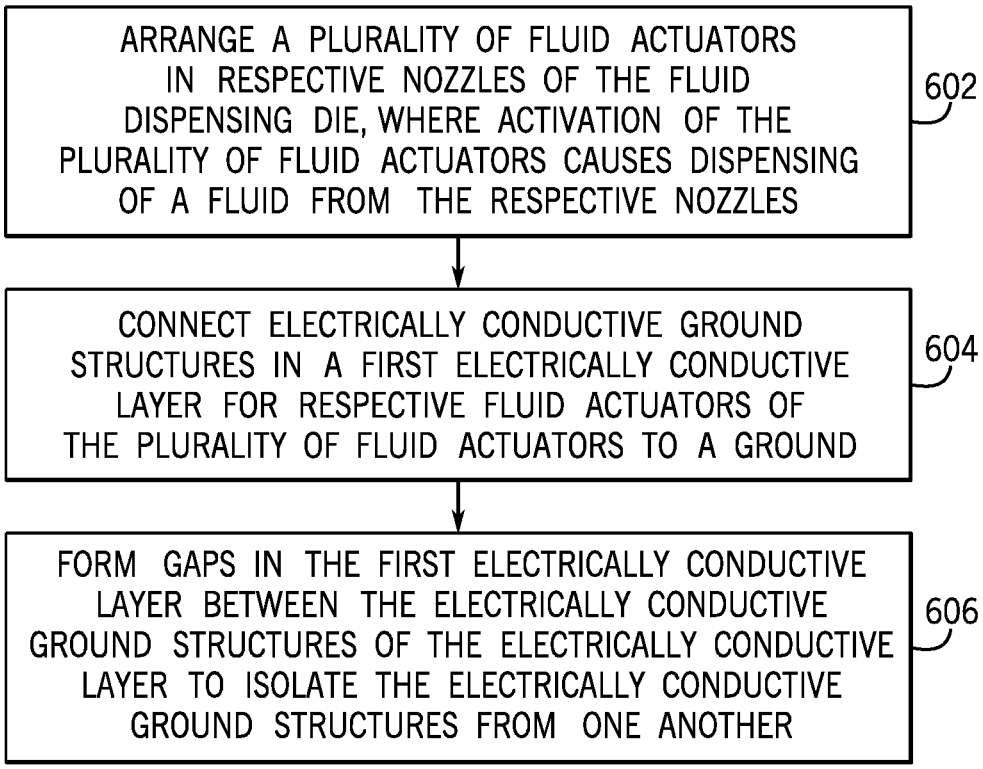
FIG. 6 is a flow diagram of a process of forming a printhead die, according to further examples.

FIG. 6 is a flow diagram of a process of forming a printhead die. The process includes arranging (at 602) a plurality of fluid actuators in respective nozzles of the fluid dispensing die, wherein activation of the plurality of fluid actuators causes dispensing of a fluid from the respective nozzles. The process further includes connecting (at 604) electrically conductive ground structures in a first electrically conductive layer for respective fluid actuators of the plurality of fluid actuators to a ground. The process additionally includes forming (at 606) gaps in the first electrically conductive layer between the electrically conductive ground structures of the electrically conductive layer to isolate the electrically conductive ground structures from one another.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A fluid dispensing die comprising:

a plurality of fluid actuators to cause dispensing of a fluid from respective nozzles of the fluid dispensing die;

a first electrically conductive layer including electrically conductive ground structures to connect respective fluid actuators of the plurality of fluid actuators to a ground, wherein the first electrically conductive layer includes gaps provided between the electrically conductive ground structures of the first electrically conductive layer;

a second electrically conductive layer that includes a ground bus; and vias to connect the electrically conductive ground structures to the ground bus, wherein a first gap is formed in the second electrically conductive layer in a space between a first via that connects to a first electrically conductive ground structure of the electrically conductive ground structures and a second via that connects to a second electrically conductive ground structure of the electrically conductive ground structures.

2. The fluid dispensing die of claim 1, wherein the first gap isolates the first via from the second via.

3. The fluid dispensing die of claim 1, wherein the first electrically conductive layer is a first metal layer, and the second electrically conductive layer is a second metal layer.

4. The fluid dispensing die of claim 1, wherein the second electrically conductive layer includes a first ground contact structure of the ground bus, and the first via connects the first electrically conductive ground structure to the first ground contact structure, and wherein the second electrically conductive layer includes a second ground contact structure of the ground bus, and the second via connects the second electrically conductive ground structure to the second ground contact structure.

5. The fluid dispensing die of claim 4, wherein a first side of the first ground contact structure is separated by the first gap in the second electrically conductive layer from the second ground contact structure, and a second side of the first ground contact structure is separated by a second gap in the second electrically conductive layer from a main portion of the ground bus.

6. The fluid dispensing die of claim 5, wherein a first side of the second ground contact structure is separated by a third gap in the second electrically conductive layer from a third ground contact structure connected by a third via to a third electrically conductive ground structure of the electrically conductive ground structures in the first electrically conductive layer, and wherein a second side of the second ground contact structure is separated by the second gap in the second electrically conductive layer from the main portion of the ground bus.

7. The fluid dispensing die of claim 6, wherein the first gap and the second gap in the second electrically conductive layer form a generally T-shaped gap.

8. The fluid dispensing die of claim 1, wherein the plurality of fluid actuators comprise resistors or piezoelectric actuators.

9. The fluid dispensing die of claim 1, further comprising:

a barrier layer between the first electrically conductive layer and the second electrically conductive layer to inhibit propagation of corrosion between the first electrically conductive layer and the second electrically conductive layer.

10. A fluid dispensing die comprising:

a plurality of fluid actuators to cause dispensing of a fluid from respective nozzles of the fluid dispensing die;

a first metal layer including ground return electrodes to connect respective fluid actuators of the plurality of fluid actuators to a ground, wherein the first metal layer includes gaps between the ground return electrodes of the first metal layer;

a second metal layer including a ground bus connected to the ground return electrodes;

a first via connecting a first ground return electrode of the ground return electrodes to the ground bus formed in the second metal layer; and a second via connecting a second ground return electrode of the ground return electrodes to the ground bus, wherein a first gap of the gaps isolates the first via from the second via.

11. The fluid dispensing die of claim 10, further comprising:

a gap in the second metal layer formed in a space between the first via and the second via.

12. The fluid dispensing die of claim 10, wherein the ground bus includes electrical ground contact portions that are connected to the first and second vias, and the second metal layer further includes gaps provided between the electrical ground contact portions and a main portion of the ground bus.

13. The fluid dispensing die of claim 12, wherein each gap of the gaps in the second metal layer is a generally T-shaped gap.

14. The fluid dispensing die of claim 10, further comprising:

a barrier layer between the first metal layer and the second metal layer to inhibit propagation of corrosion between the first metal layer and the second metal layer.

15. The fluid dispensing die of claim 10, wherein the plurality of fluid actuators comprise resistors or piezoelectric actuators.

16. A method of forming a printhead die, comprising:

arranging a plurality of fluid actuators in respective nozzles of the fluid dispensing die, wherein activation of the plurality of fluid actuators causes dispensing of a fluid from the respective nozzles;

connecting electrically conductive ground structures in a first electrically conductive layer for respective fluid actuators of the plurality of fluid actuators to a ground;

forming gaps in the first electrically conductive layer between the electrically conductive ground structures of the first electrically conductive layer to isolate the electrically conductive ground structures from one another;

connecting, by vias, the electrically conductive ground structures to a ground bus formed in a second electrically conductive layer; and forming a first gap in the second electrically conductive layer in a space between a first via that connects to a first electrically conductive ground structure of the electrically conductive ground structures and a second via that connects to a second electrically conductive ground structure of the electrically conductive ground structures.

17. The method of claim 16, wherein the first electrically conductive layer is a first metal layer, and the second electrically conductive layer is a second metal layer.

* * * * *